US010898754B2

(12) United States Patent
Sandhu

(10) Patent No.: US 10,898,754 B2
(45) Date of Patent: Jan. 26, 2021

(54) GYM TOWER

(71) Applicant: Jesse Sandhu, Surrey (CA)

(72) Inventor: Jesse Sandhu, Surrey (CA)

( * ) Notice: Subject to any disclaimer, the term of this patent is extended or adjusted under 35 U.S.C. 154(b) by 0 days.

(21) Appl. No.: 16/464,729

(22) PCT Filed: Nov. 27, 2017

(86) PCT No.: PCT/CA2017/051424
§ 371 (c)(1),
(2) Date: May 29, 2019

(87) PCT Pub. No.: WO2018/098569
PCT Pub. Date: Jun. 7, 2018

(65) Prior Publication Data

US 2019/0308069 A1 Oct. 10, 2019

(30) Foreign Application Priority Data

Nov. 30, 2016 (CA) ..... 2950029

(51) Int. Cl.
*A63B 23/035* (2006.01)
*A63B 21/062* (2006.01)
*A63B 21/00* (2006.01)
*A63B 71/00* (2006.01)

(52) U.S. Cl.
CPC .. *A63B 23/03566* (2013.01); *A63B 21/00065* (2013.01); *A63B 21/063* (2015.10); *A63B 21/0628* (2015.10); *A63B 21/0632* (2015.10); *A63B 21/152* (2013.01); *A63B 21/154* (2013.01); *A63B 21/4035* (2015.10); *A63B 71/0036* (2013.01); *A63B 2210/50* (2013.01); *A63B 2225/102* (2013.01)

(58) Field of Classification Search
CPC ..... A63B 21/00065; A63B 21/0632; A63B 21/0628; A63B 21/063; A63B 21/152; A63B 21/154; A63B 21/4035; A63B 71/03566; A63B 71/0036; A63B 2210/50; A63B 2225/102
See application file for complete search history.

(56) References Cited

U.S. PATENT DOCUMENTS 4,256,301 A 3/1981 Goyette
4,257,590 A 3/1981 Sullivan et al.
4,456,246 A 6/1984 Szabo
4,540,171 A 9/1985 Clark et al.
(Continued)

*Primary Examiner* — Megan Anderson
(74) *Attorney, Agent, or Firm* — Nexus Law Group LLP; Nicholas P. Toth

(57) ABSTRACT

A gym tower which includes a base and a plurality of internal weights vertically stacked on the base. A frame is connected to the base and extends upward from the base to engage with the plurality of internal weights. A top plate is connected to the frame, so that the base and the plate enclose the plurality of internal weights within the frame. The tower also includes a spine is adapted to selectively engage the plurality of internal weights. A main pulley is connected to the top plate and a main cable is fed through the main pulley. The main cable is connectable to the spine at a first end and includes a connector device at a second end. The tower also includes a rod adapted to engage with the spine and to select an internal weight and is adapted to secure to external weights.

12 Claims, 7 Drawing Sheets

(56) References Cited

U.S. PATENT DOCUMENTS

| | | | | |
|---|---|---|---|---|
| 4,632,388 | A * | 12/1986 | Schleffendorf | A63B 21/06 482/102 |
| 4,974,838 | A | 12/1990 | Sollenberger | |
| 6,394,935 | B1 | 5/2002 | Lake | |
| 6,770,015 | B2 | 8/2004 | Simonson | |
| 7,316,638 | B1 * | 1/2008 | Fabela | A63B 21/063 482/93 |
| 8,328,697 | B2 * | 12/2012 | Farbshteyn | A63B 21/0615 482/100 |
| 8,900,097 | B1 | 12/2014 | Griggs et al. | |
| 2007/0179030 | A1 | 8/2007 | Slawinski | |

* cited by examiner

GYM TOWER

COPYRIGHT NOTICE

This patent document contains material which is subject to copyright protection. The copyright owner has no objection to the facsimile reproduction by anyone of this patent document as it appears in the Patent and Trademark Office patent file or records, but otherwise reserves all copyright rights whatsoever.

FIELD OF THE INVENTION

The invention relates to the field of gym equipment, and in particular, to a gym tower for home or exercise club use.

BACKGROUND OF THE INVENTION

As we lead more sedentary lives, gym memberships and the use of home strength and weight training equipment is becoming more popular. Present gym equipment includes weight machines and gym racks. These units are commonly discrete units, with each unit encompassing a significant footprint. Users requiring the use of both types of equipment are required to move from one station to another.

Home gyms typically do not have enough space to accommodate more than one gym apparatus, hence limiting a user's gym experience.

Accordingly, a need exists for a gym apparatus that is compact and enables a user to perform a variety of gym exercises. Other objects of the invention will be apparent from the description that follows.

SUMMARY OF THE INVENTION

According to the present invention, there is provided a gym tower. The tower includes a base and a plurality of internal weights vertically stacked on the base. A frame is connected to the base and extends upward from the base to engage with the plurality of internal weights. A top plate is connected to the frame, so that the base and the plate enclose the plurality of internal weights within the frame. The tower also includes a spine adapted to selectively engage the plurality of internal weights. A main pulley is connected to the top plate and a main cable is fed through the main pulley. The main cable is connectable to the spine at a first end and includes a connector device at a second end. The tower also includes a rod adapted to engage with the spine and to select an internal weight and is adapted to secure to external weights.

The frame may include four posts with each post shaped vertically at a right-angle. The right-angle posts may extend vertically through the plurality of internal weights and may extend vertically through a corner of each internal weight.

Each internal weight may include a vertical and a horizontal through-hole, and the spine may be adapted to insert and slide within the vertical through-hole of each internal weight. The rod may be adapted to insert through a horizontal through-hole of a selected internal weight. Each internal weight may include a center bore and a handle bore. A peg may be included which is adapted to insert into the center bore. A secondary handle may be included which is adapted to insert into the handle bore. The rod may be adapted to extend through and past a through-hole of an internal weight.

The spine may include a vertical section and a horizontal section, with the main cable connecting to the spine at the horizontal section.

The gym tower may also include a secondary pulley connected to the tower.

Additionally, the gym tower may also include a slider panel connected to the base which may extend upward from the base through the plurality of internal weights. The spine may be adapted to insert and slide within the slider panel.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
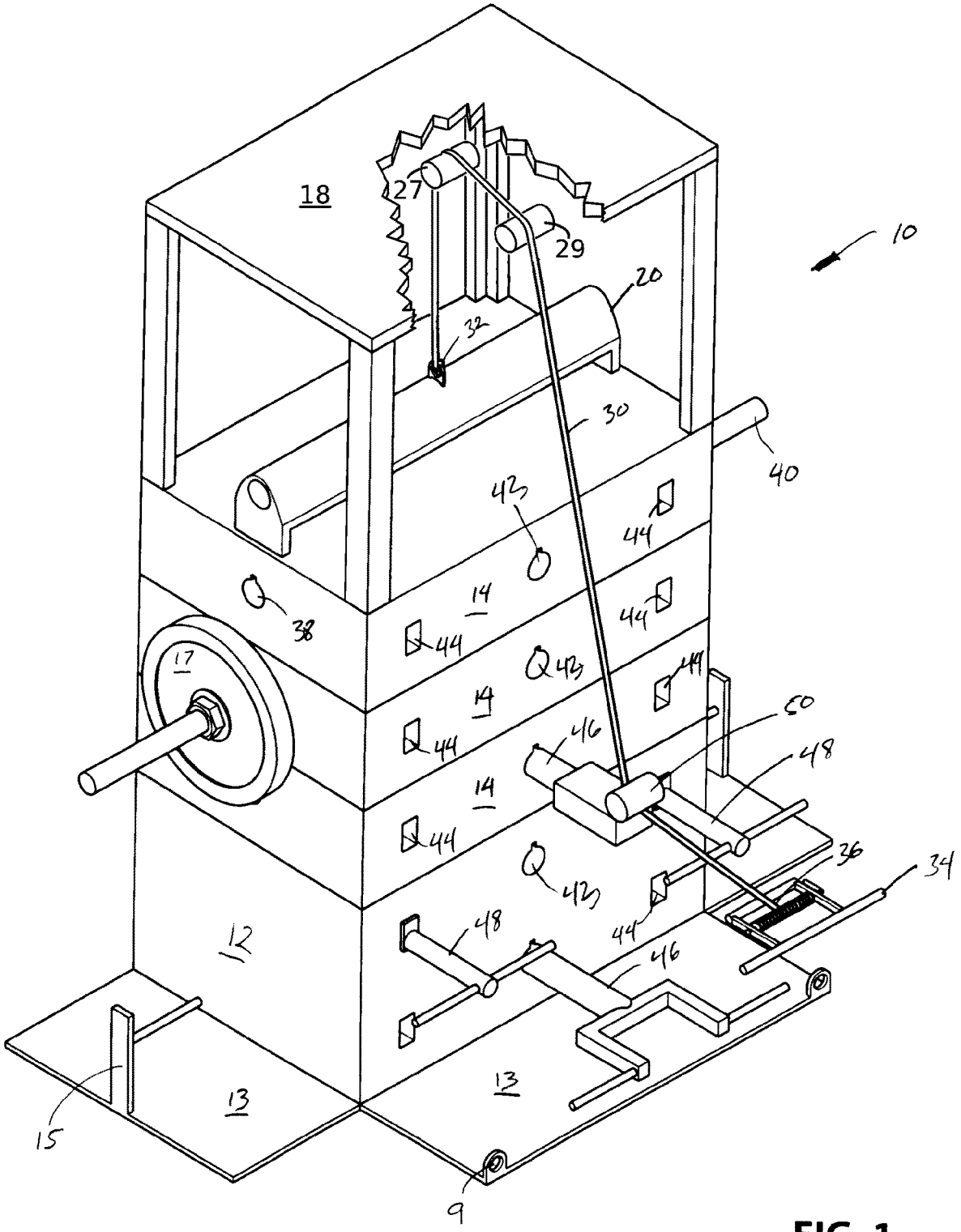
FIG. 1 is a perspective view of the gym tower of the present invention.
Figure 2:
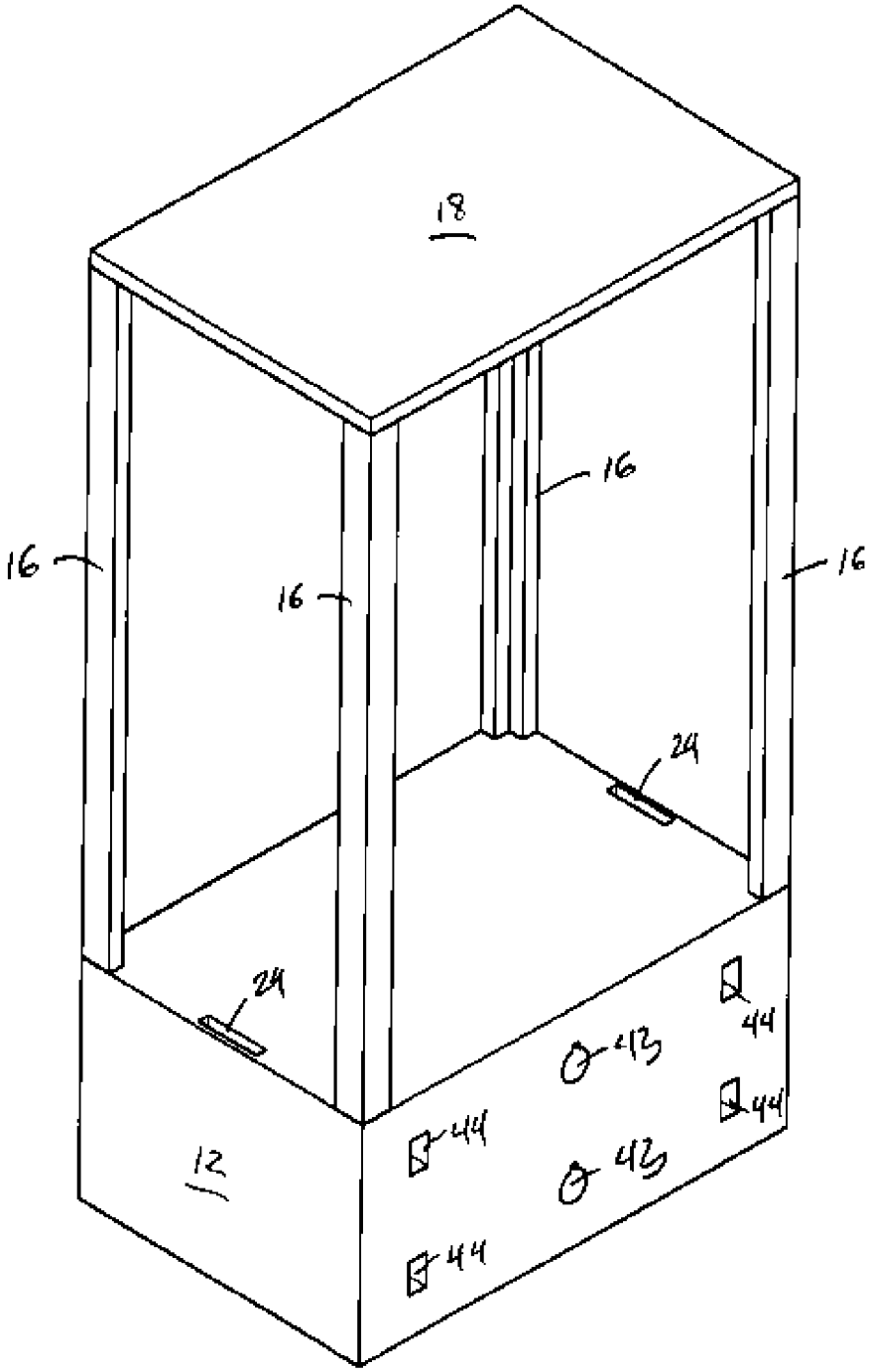
FIG. 2 is a perspective view of a preferred embodiment of a frame of present invention.

A gym tower 10 is depicted in FIG. 1. Tower 10 includes a base 12 and a plurality of internal weights 14 vertically stacked on the base. Preferably, the base 12 will be the heaviest piece in the tower 10 to prevent the tower from tipping during use. Additionally, the base 12 may have footing 13 to further prevent the tower 10 from tipping. The underside of the base 12 may be covered in rubber to frictionally engage the floor and to protect the floor from scuffs and marks. Base 12 may be formed by two parts stacked upon each other or it may simply be a unitary body as depicted. Base 12 may additionally include upright pegs 15 at the corners of the footing 13 which could be used for external weight 17 storage as well as anchoring down the tower 10. The base 10 may further include hooks 9 for a user to attach resistance bands thereto.

Figure 6:
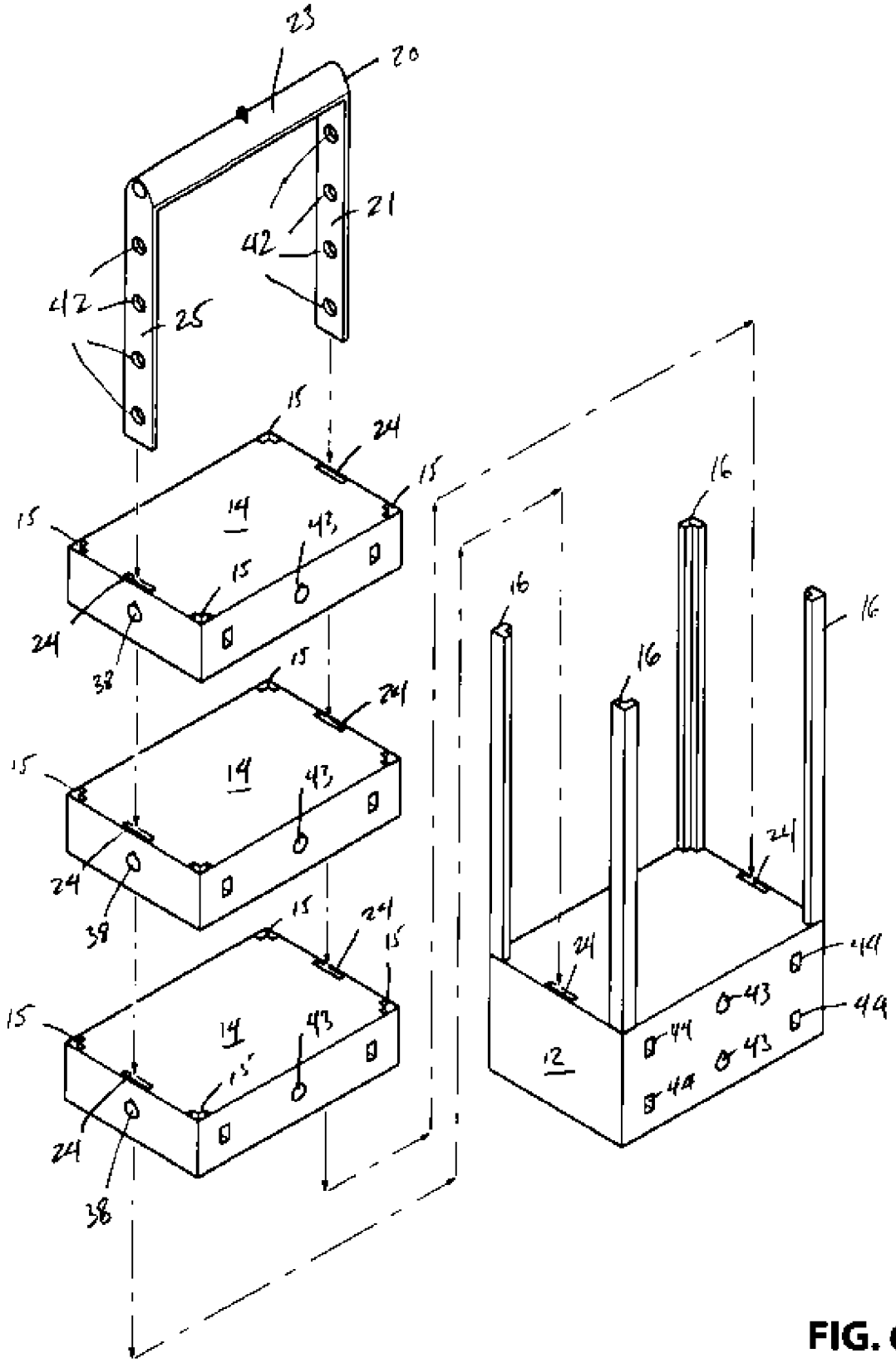
FIG. 6 is an exploded perspective view the preferred spine and a plurality of internal weights stacked atop of the base of the present invention.
Figure 7:
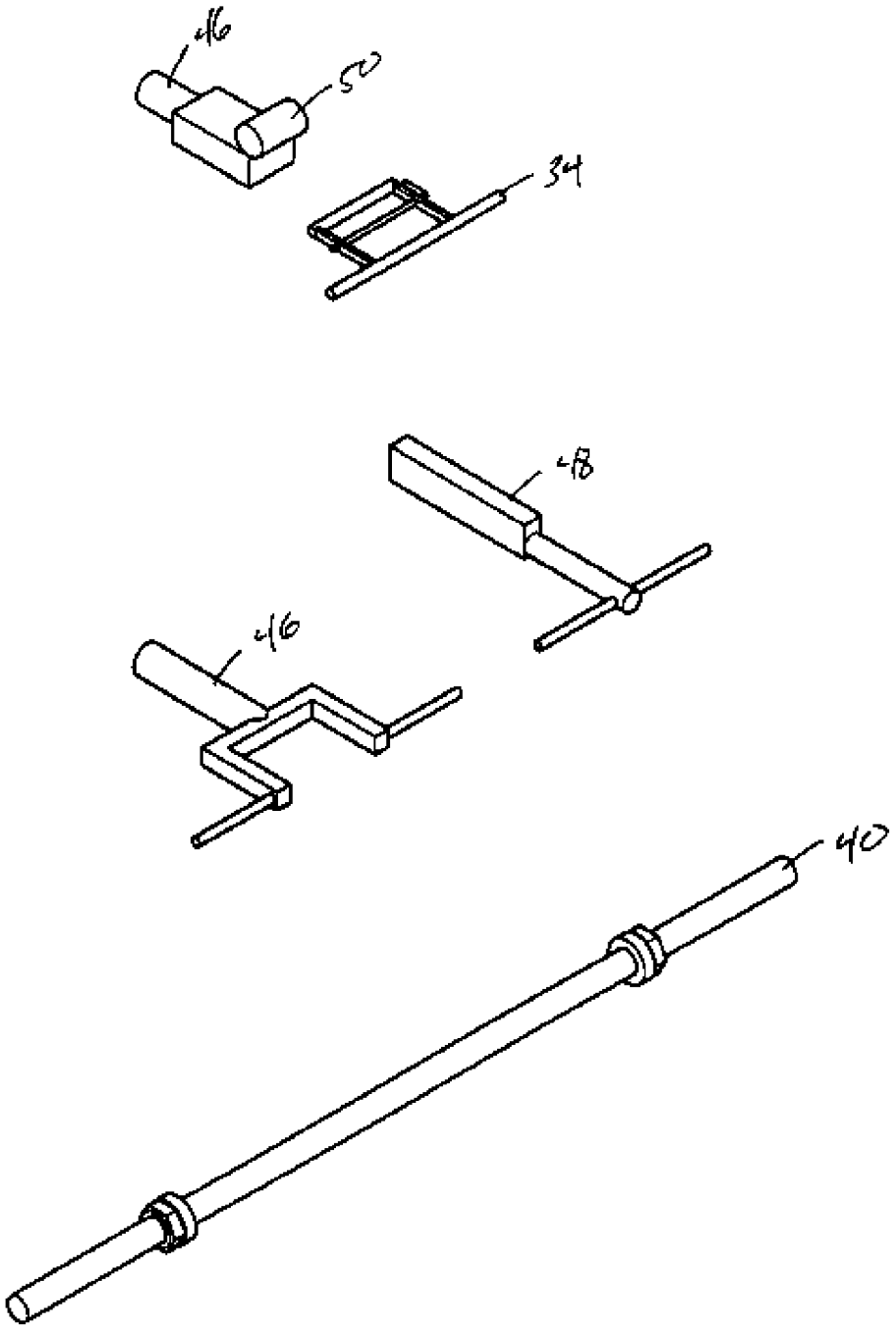
FIG. 7 are perspective views of a variety of secondary handles and a rod.

As best depicted in FIG. 6 a frame 16 is connected to the base 12 and extends upward from the base to engage with the plurality of internal weights 14. Preferably, the frame 16 includes four posts with each post shaped at a right-angle. The right-angle posts each extend vertically through right-angle slots 15 at each corner of each internal weight. The posts of the frame 16 thus, act as tracks for the plurality of internal weights 14 to move up and down in the tower 10. In this configuration, the plurality of internal weights 14 act to support the frame 16 from bending when the tower 10 is being used. Although not ideal, the frame 16 may also engage the plurality of weights 14 on the outside of each corner of the plurality of internal weights, thus serving as outside tracks for the internal weights to move up and down in the tower 10. In this configuration, the plurality of internal weights 14 may not prevent the frame 16 from bending when under load. Additionally, tower 10 includes a top plate 18 connected to the frame 16 using conventional techniques to enclose the plurality of weights 14 within the frame.

Figure 4:
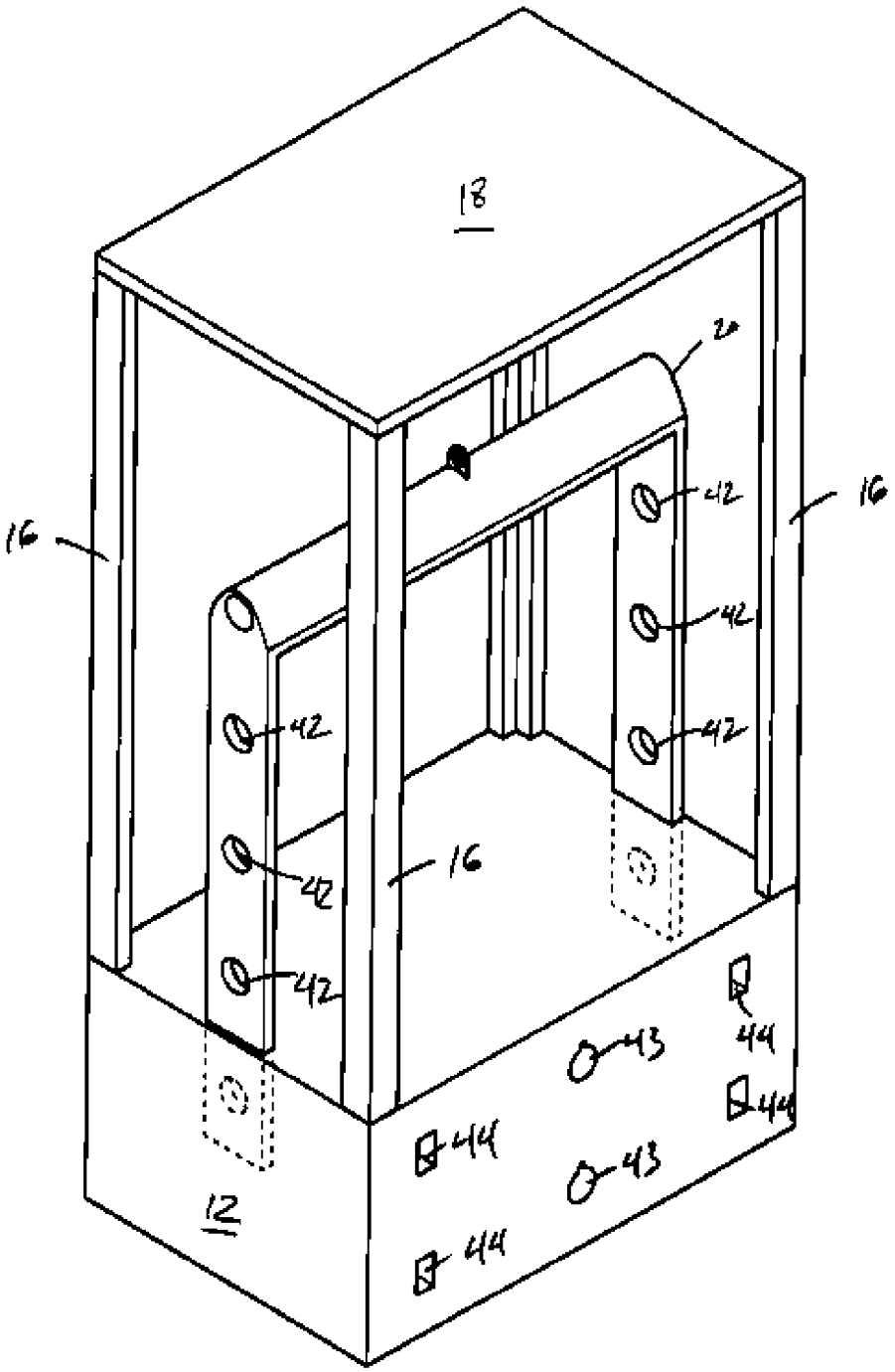
FIG. 4 is a perspective view of the preferred spine engaged with a base of the present invention.
Figure 5:
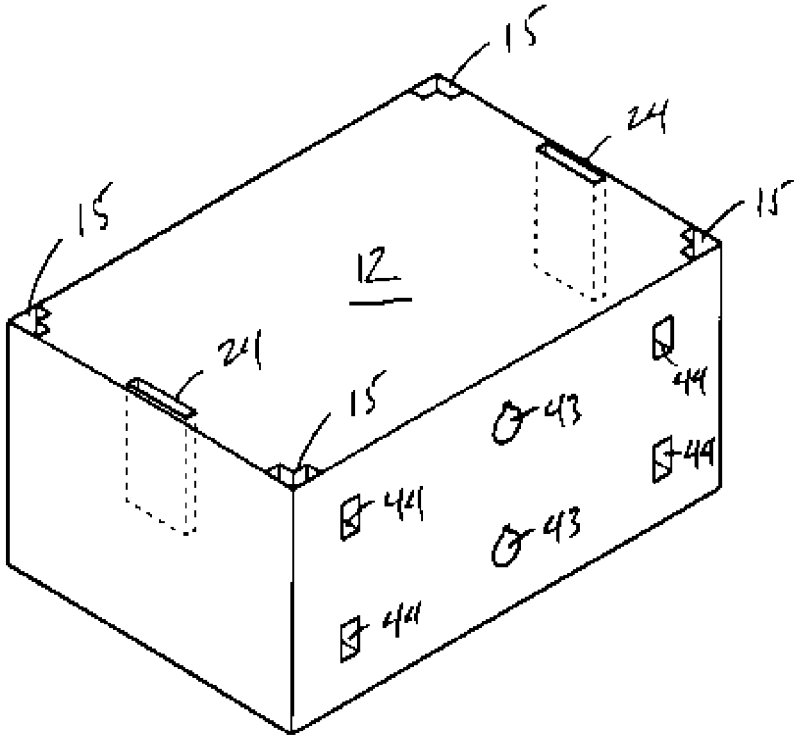
FIG. 5 is a perspective view of the base of the present invention.

Referring to FIGS. 1, 4 and 6, the tower 10 also includes a spine 20 adapted to selectively engage the plurality of internal weights 14 and is sufficiently long to engage with the base 12. The spine 20 may be a typical cylindrical spine (not depicted) that is adapted to insert and slide within vertical central through-holes located in each weight as seen conventional home gym systems. However, and preferably, as illustrated, the spine 20 is a plate which engages the plurality of internal weights 14 adjacent an edge of each weight. Here, spine 20 may slide along the outside edges of the plurality of internal weights 14, but preferably the spine inserts and slides through vertical through-holes 24 or slots in each internal weight and the base 12. Advantageously, the spine 20 and the frame 16 are supported by the plurality of internal weights 14 from any bending loads. Preferably, spine 20 is of sufficient length to remain engaged with the base 12 while it is being pulled up towards the top plate 18 while the tower 10 is being used. Alternatively, the tower 10 may include a slider panel connected to the base 12 which may extend upward from the base through the plurality of internal weights 14. Here, the spine 20 may be adapted to insert and slide within the slider panel.

Figure 3:
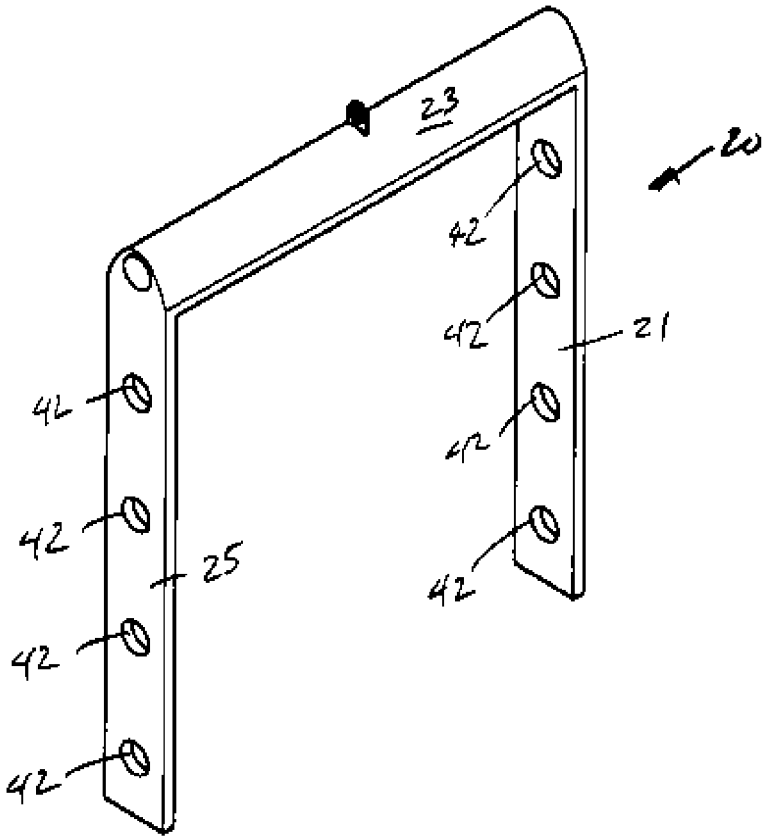
FIG. 3 is a perspective view of a preferred embodiment of a spine of the present invention.

Referring back to FIG. 1, the tower 10 also includes a conventional main pulley 27 connected to the top plate 18 using conventional techniques and a main cable 30 is fed through the main pulley 27. The main cable 30 is connectable to the spine 20 at a first end 32 and connectable via a conventional connector to a main handle 34 at a second end 36. As best shown in FIG. 3, preferably, the spine 20 includes a vertical section 21 and a horizontal section 23 with the main cable 30 connecting to the spine at the horizontal section using conventional techniques. To better distribute the force from a user pulling on the main cable 30, the spine 20 includes an additional vertical section 25 connected to the horizontal section 23 so that the spine resembles an elongated and inverted u-shaped saddle. The tower 10 may also include a conventional auxiliary pulley 29 connected to the top plate 18 to bring the main cable 30 more towards a user.

Referring to FIGS. 1, and 6, each internal weight includes a horizontal through-hole 38. To engage the spine 20 with a particular internal weight, tower 10 includes a rod 40 adapted to insert through horizontal through-hole 38. The spine 20 also includes a through-hole 42 configured to receive the rod 40. The rod 40 is of sufficient length to pass from one edge of an internal weight to the opposite edge. The rod 40 may also be adapted to conventionally secure to an external weight 17. Each weight in the stack of plurality of internal weights 14 may be of the same dimension and mass. Alternatively, each weight may be separately dimensioned and of varying mass depending upon a user's needs.

Referring to FIGS. 1, 4, 5, 6. and 7 Each internal weight and the base 10 each include a center bore 43 and a handle bore 44. A peg 46 is included with tower 10 and is adapted to insert into the center bore 43. Additionally, a secondary handle 48 is included and is adapted to insert into the handle bore 44. Center bore 43 may also accommodate other attachment devices as depicted. The secondary handle 48 may include a variety of shapes to accommodate a variety of exercise techniques. Peg 46 may be adapted to also conventionally secure an external weight 17. As depicted, each internal weight has two handle bores 44 on either side of the weight. Ideally, handle bores 44 are positioned wide enough for a user to perform wide grip exercises.

The gym tower also includes a secondary pulley 50 connectable to the peg 46. To make the use of tower 10 more dynamic, peg 46 with connected pulley 50 can be placed into any center bore 43. A secondary cable may then loop through secondary pulley 50 and connects at one end to a conventional connector on the main cable 30 and attaches to a body harness or another handle at the other end. Preferably, the secondary cable includes a conventional retractable device that enables a user to easily configure its length Operation Ideally, the tower 10 includes a manual with a variety of recommended exercises and the associated tower configuration. However, a user may also configure the tower 10 to suit personal requirements. In selecting an exercise, a user may take rod 40 and insert it into a specific internal weight and spine 20 location. If a user wishes to fine tune the amount of weight to use, the user may add the peg 46 to center bore 43 of the weight being lifted and may add any number of external weights 17. Additionally, external weights 17 may be added to rod 40 to further fine tune the amount of weight to be lifted. For calisthenics, rather than moving to another station, a user may simply attach a secondary handle 48 into the handle bore 44 of a particular internal weight (depending on required height and angle of use) and work away knowing the overall weight of the tower 10 will support the user's activity. To increase the callisthenic workout, a user may attach a body harness so that their workout includes use of additional external weights 17.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A gym tower comprising:

a base;

a plurality of internal weights vertically stacked on said base;

a frame connected to said base and extending upward from said base to engage with said plurality of internal weights, said frame comprising four posts each extending vertically through said plurality of internal weights;

a top plate connected to said frame, wherein said base and said top plate enclose said plurality of internal weights within said frame;

a spine adapted to selectively engage with said plurality of internal weights;

a main pulley connected to said top plate;

a main cable fed through said top pulley, said main cable connectable to said spine at a first end and comprising connector means at a second end; and a rod adapted to engage with said spine and to select a selected internal weight of said plurality of internal weights, said rod being further adapted to secure to external weights.

2. The gym tower of claim 1 wherein each of said four posts is shaped to comprise a right-angle cross-section.

3. The gym tower of claim 1 wherein each internal weight of said plurality of internal weights comprises a vertical and a horizontal through-hole, said spine being adapted to insert and slide within said vertical through-holes of said plurality of internal weights and said rod being adapted to insert through a selected said horizontal through-hole of a selected internal weight of said plurality of internal weights.

4. The gym tower of claim 1 wherein each internal weight of said plurality of internal weights comprises a vertical slot and a horizontal through-hole, said spine being adapted to insert and slide within said vertical slots of said plurality of internal weights and said rod being adapted to insert through a selected said horizontal through-hole of a selected internal weight of said plurality of internal weights.

5. The gym tower of claim 1 wherein each internal weight of said plurality of internal weights comprises a center bore and a handle bore.

6. The gym tower of claim 1 wherein said rod is adapted to extend through and past a through-hole of a selected internal weight of said plurality of internal weights.

7. The gym tower of claim 1 wherein said spine comprises a vertical section and a horizontal section, said main cable connecting to said spine at said horizontal section.

8. The gym tower of claim 1 further comprising a secondary pulley connectable to said gym tower.

9. A gym tower comprising:

a base;

a plurality of internal weights vertically stacked on said base;

a frame connected to said base and extending upward from said base to engage with said plurality of internal weights, said frame comprising four right angle posts that extend vertically through said plurality of internal weights;

a top plate connected to said frame, wherein said base and said top plate enclose said plurality of internal weights within said frame;

a spine adapted to selectively engage with said plurality of internal weights;

a main pulley connected to said top plate;

a main cable fed through said to pulley, said main cable connected to said spine at a first end and comprising connector means at a second end; and a rod adapted to engage with said spine and to select a selected internal weight of said plurality of internal weights, said rod being further adapted to secure to external weights.

10. The gym tower of claim 9 wherein each of said four right angle posts extend vertically through a corner of each internal weight of said plurality of internal weights.

11. A gym tower comprising:

a base;

a plurality of internal weights vertically stacked on said base, each of said plurality of internal weights comprising a center bore and a handle bore;

a frame connected to said base and extending upward from said base to engage with said plurality of internal weights;

a top plate connected to said frame, wherein said base and said top plate enclose said plurality of internal weights within said frame;

a spine adapted to selectively engage with said plurality of internal weights;

a main pulley connected to said top plate;

a main cable fed through said to pulley, said main cable connectable to said spine at a first end and comprising connector means at a second end; and a rod adapted to engage with said spine and to select a selected internal weight of said plurality of internal weights, said rod being further adapted to secure to external weights, wherein the gym tower further comprises a peg adapted to insert into said center bore.

12. A gym tower comprising:

a base;

a plurality of internal weights vertically stacked on said base, each of said plurality of internal weights comprising a center bore and a handle bore;

a frame connected to said base and extending upward from said base to engage with said plurality of internal weights;

a top plate connected to said frame, wherein said base and said top plate enclose said plurality of internal weights within said frame;

a spine adapted to selectively engage with said plurality of internal weights;

a main pulley connected to said top plate;

a main cable fed through said top pulley, said main cable connectable to said spine at a first end and comprising connector means at a second end; and a rod adapted to engage with said spine and to select a selected internal weight of said plurality of internal weights, said rod being further adapted to secure to external weights, wherein the gym tower further comprises a secondary handle adapted to insert into said handle bore.

* * * * *